US008197110B2

(12) United States Patent
Czajkowski

(10) Patent No.: US 8,197,110 B2
(45) Date of Patent: Jun. 12, 2012

(54) LIGHT ASSEMBLY INCORPORATING REFLECTIVE FEATURES

(75) Inventor: Bob Czajkowski, Tinley Park, IL (US)

(73) Assignee: Federal Signal Corporation, Oak Brook, IL (US)

( * ) Notice: Subject to any disclaimer, the term of this patent is extended or adjusted under 35 U.S.C. 154(b) by 0 days.

(21) Appl. No.: 11/712,769

(22) Filed: Mar. 1, 2007

(65) Prior Publication Data

US 2007/0153530 A1 Jul. 5, 2007

Related U.S. Application Data

(63) Continuation-in-part of application No. 10/962,875, filed on Oct. 12, 2004, now Pat. No. 7,578,600.

(51) Int. Cl.
*F21V 7/00* (2006.01)

(52) U.S. Cl. ..... 362/518; 362/240; 362/241; 362/247; 362/297; 362/311.07; 362/346; 362/545

(58) Field of Classification Search ..... 362/240–241, 362/247, 296–298, 301–302, 341, 346, 516–518, 362/249.02, 311.07, 545, 800
See application file for complete search history.

(56) References Cited

U.S. PATENT DOCUMENTS

| | | | | |
|---|---|---|---|---|
| 4,929,866 | A | 5/1990 | Murata et al. | |
| 5,278,731 | A | 1/1994 | Davenport et al. | |
| 5,321,586 | A | 6/1994 | Hege et al. | |
| 5,471,371 | A | 11/1995 | Koppolu et al. | |
| 5,528,474 | A * | 6/1996 | Roney et al. | 362/545 |
| 5,704,709 | A | 1/1998 | Zwick | |
| 5,924,785 | A | 7/1999 | Zhang et al. | |
| 5,929,788 | A | 7/1999 | Vukosic | |
| 6,257,737 | B1 | 7/2001 | Marshall | |
| 6,318,886 | B1 | 11/2001 | Stopa et al. | |
| 6,332,701 | B1 | 12/2001 | Yamada | |
| 6,601,970 | B2 | 8/2003 | Ueda | |
| 6,641,284 | B2 | 11/2003 | Stopa et al. | |
| 6,899,443 | B2 | 5/2005 | Rizkin | |
| 6,945,672 | B2 | 9/2005 | Du | |
| 7,578,600 | B2 | 8/2009 | Czajkowski | |
| 2002/0118548 | A1 | 8/2002 | Kuenstler | |
| 2003/0095399 | A1 * | 5/2003 | Grenda et al. | 362/30 |
| 2004/0042212 | A1 | 3/2004 | Du | |
| 2004/0114366 | A1 | 6/2004 | Smith | |
| 2004/0196663 | A1 | 10/2004 | Ishida | |
| 2005/0018147 | A1 | 1/2005 | Lee | |

FOREIGN PATENT DOCUMENTS

DE 101 40 692 A1 3/2003

(Continued)

OTHER PUBLICATIONS

Costlow, "LEDs shine on, "*aei*, Dec. 2003, pp. 24 and 26-28.

(Continued)

*Primary Examiner* — Jason Moon Han
(74) *Attorney, Agent, or Firm* — Merchant & Gould P.C.

(57) ABSTRACT

A light assembly is disclosed which can include one or more light emitting diodes and a reflector. The reflector includes a reflective surface and is positioned to reflect at least a portion of the light emitted by the light emitting diode. The reflector further includes a pair of flanking planar reflective surfaces. The flanking planar reflective surfaces can be positioned at a distance one half the predetermined distance between two light emitting diodes, and can simulate an extended length of the reflector.

10 Claims, 15 Drawing Sheets

FOREIGN PATENT DOCUMENTS

| | | |
|---|---|---|
| EP | 1 094 271 A2 | 4/2001 |
| ES | 2 185 509 | 4/2003 |

OTHER PUBLICATIONS

LEDs Brighten Auto Design, "*Design News*" Dec. 1, 2003, pp. 38 and 40.

Kaminski, Mark E., "LED Illumination Design in vol. Constraint Environments," *Society of Photo-Optical Instrumentation Engineers*, Aug. 2005, 8 pages.

Koshel, John R., "Lit Appearance Modeling of Illumination Systems," *Society of Photo-Optical Instrumentation Engineers*, Jul. 2002, 9 pages.

U.S. Appl. No. 12/542,392, filed on Aug. 17, 2009.

* cited by examiner

FIG. 16

RED

Combined

| | -45 | -40 | -35 | -30 | -25 | -20 | -15 | -10 | -5 | 0 | 5 | 10 | 15 | 20 | 25 | 30 | 35 | 40 | 45 |
|---|---|---|---|---|---|---|---|---|---|---|---|---|---|---|---|---|---|---|---|
| 10 | | | | | | | | | 20 | 50 | 20 | | | | | | | | |
| 5 | 80 | 80 | 80 | 80 | 80 | 80 | 80 | 80 | 100 | 150 | 100 | 80 | 80 | 80 | 80 | 80 | 80 | 80 | 80 |
| 0 | 167 | 167 | 167 | 167 | 167 | 167 | 167 | 167 | 300 | 600 | 300 | 167 | 167 | 167 | 167 | 167 | 167 | 167 | 167 |
| -5 | 80 | 80 | 80 | 80 | 80 | 80 | 80 | 80 | 100 | 150 | 100 | 80 | 80 | 80 | 80 | 80 | 80 | 80 | 80 |
| -10 | | | | | | | | | 20 | 50 | 20 | | | | | | | | |

Note: All values converted to equivalent steady burn values in candelas.

LIGHT ASSEMBLY INCORPORATING REFLECTIVE FEATURES

CROSS REFERENCE TO RELATED APPLICATIONS

This application is a continuation-in-part of and claims priority to U.S. patent application Ser. No. 10/962,875, filed Oct. 12, 2004, which claims the benefit of U.S. Provisional Patent Application No. 60/510,192 filed Oct. 10, 2003, both of which are incorporated herein by reference in the entirety.

TECHNICAL FIELD

This invention relates in general to light assemblies, and more particularly to a light assembly which includes a light-emitting diode (LED).

BACKGROUND

The light output of an LED can be highly directional. This directionality has been a detriment when trying to couple LEDs with conventional parabolic reflectors. The directionality of an LED, taken together with the desire to shape the light output in different and sometimes opposite ways to yield a desired performance specification, has resulted in LED lighting systems that frequently employ lens elements in addition to reflectors to shape the beam. These LED-lens-reflector systems can suffer from poor optical efficiency. U.S. Pat. No. 6,318,886 describes a method whereby a beam pattern is produced with LED light sources and a variation of a conventional reflector.

SUMMARY

The invention provides a light assembly that can include an LED and a reflector. The LED is disposed with respect to the reflector such that an optical output axis of the LED is in offset, intersecting relationship to a principal axis of a reflective surface of the reflector such that the output axis is in non-parallel relationship with the principal axis of the reflective surface. The reflective surface can include a linear curved section. The curved section can be defined by a parabolic equation. The relationship between the LED and the reflective surface can facilitate beam shaping and improve light collection efficiency.

The reflector can take advantage of the directionality of the LED to orient and direct substantially all the light from the LED to the areas where it is desired and at light output levels appropriate to each area. As a result, the reflector design of the invention can have extremely high optical efficiency.

In one particular aspect, a light assembly includes a light emitting diode and a reflector. The reflector includes a reflective surface and is positioned to reflect at least a portion of the light emitted by the light emitting diode. The reflector further includes a pair of flanking planar reflective surfaces.

In a second aspect, a light assembly includes an array of light emitting diodes and a reflector. The reflector includes a reflective surface having a plurality of parabolic reflective regions corresponding to the plurality of light emitting diodes in the array, and is configured to reflect at least a portion of the light emitted by the light emitting diodes.

In a third aspect, a light assembly includes an array of light emitting diodes, the light emitting diodes regularly spaced at a predetermined distance and linearly arranged. The light assembly also includes a reflector including a reflective surface, the reflector positioned to reflect at least a portion of the light emitted by the array of light emitting diodes, and the reflector further including a pair of flanking planar reflective surfaces positioned at a distance one half the predetermined distance between the light emitting diodes.

BRIEF DESCRIPTION OF THE DRAWINGS

FIG. 16 is a table associated with a combined light output specification comprising a combination of standards wherein the highest value for a particular location is selected as the value for the combined specification;

DETAILED DESCRIPTION

Figure 1:
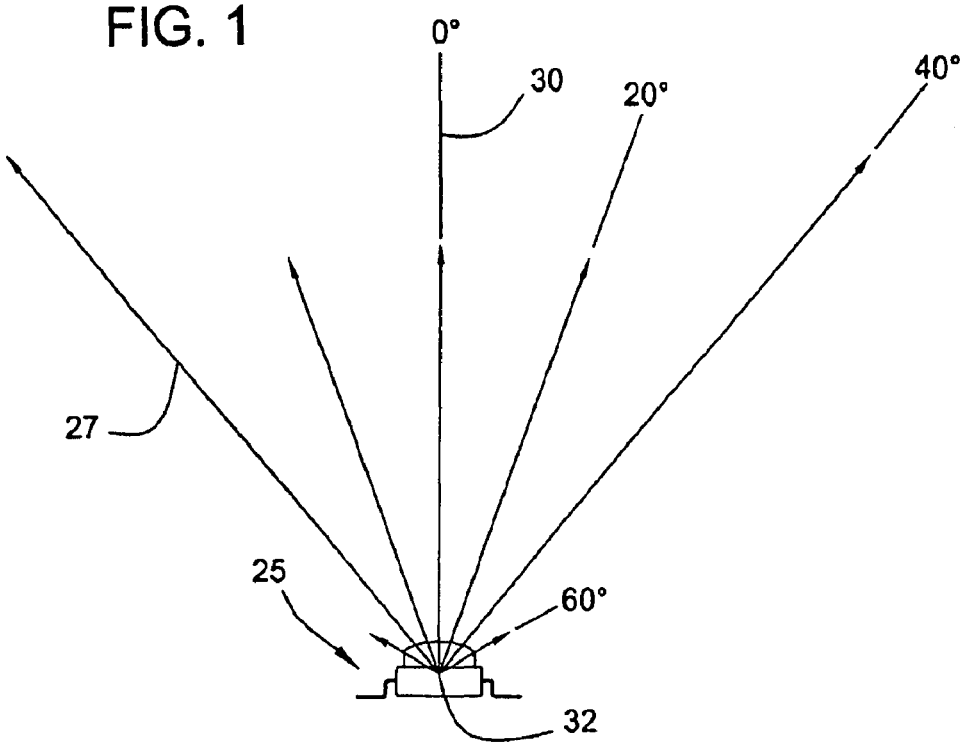
FIG. 1 is an elevational view of an LED useful in connection with the present invention.
Figure 2:
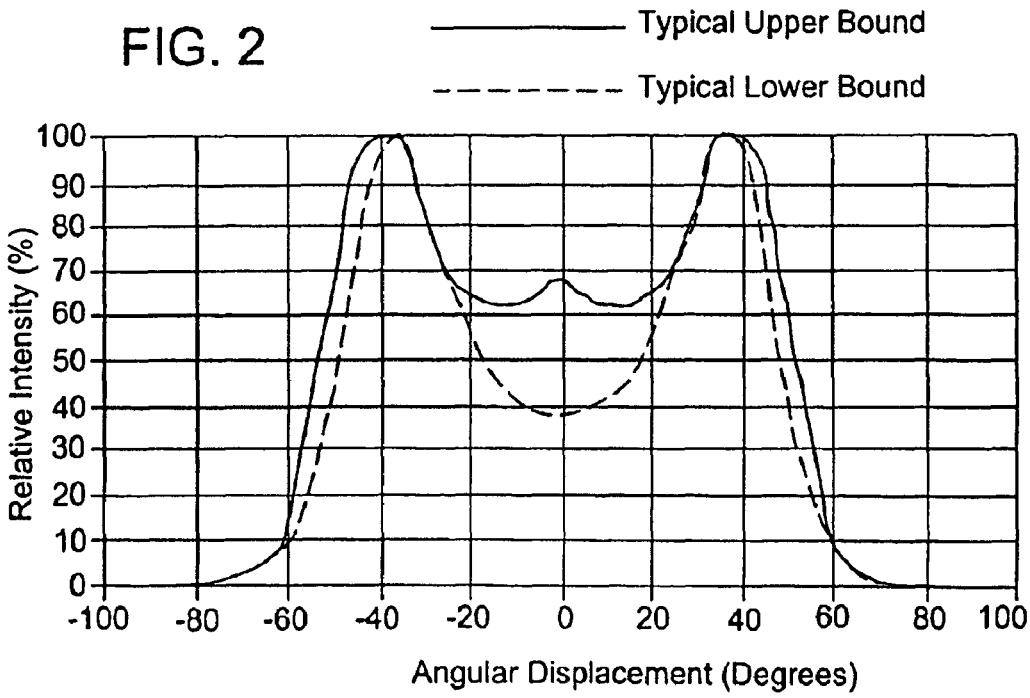
FIG. 2 is a graph of relative intensity (percentage) versus angular displacement (degrees) for a LED.

Referring to FIGS. 1 and 2, the spatial radiation pattern from a typical high output LED 25, in this case a Lumileds Luxeon® LED, along with a graphical representation of the light output of the LED 25 is shown by way of a plurality of arrows 27 with the length of the arrow 27 corresponding to the relative light intensity output for the LED at that location. The radiation pattern clearly demonstrates that the highest light output occurs at approximately 40° from both directions from an optical output axis 30 of the LED (shown in FIGS. 1 and 2 as a 0° axis), and that the majority of the light is produced within 60° from both directions from the output axis 30. The output axis 30 can extend substantially through the center of the face of the lens of the LED through a virtual focal point 32 of the LED. Since the die that produces the light in the LED is a finite size, the virtual focal point 32 can be a theoretical point within the LED where the majority of the light rays being emitted by the die appear to originate. It is also apparent from FIGS. 1 and 2 that the spatial light output characteristics of the LED are independent of color.

Figure 4:
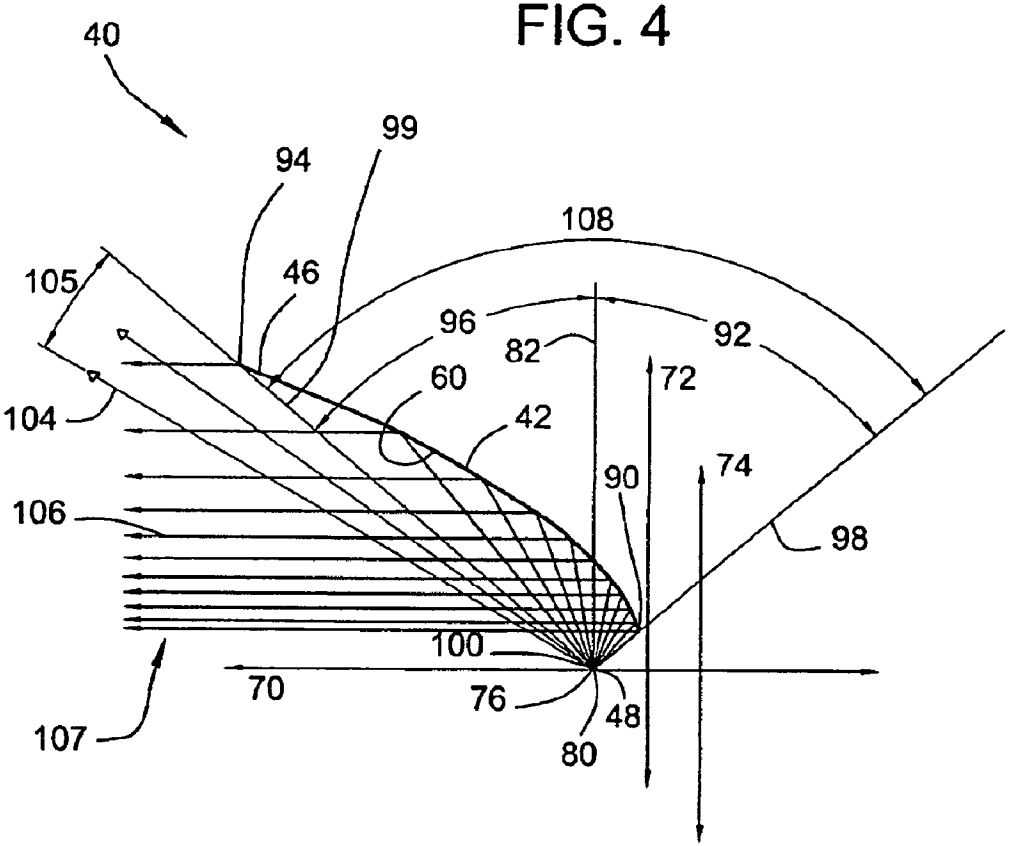
FIG. 4 is a sectional view of a light assembly according to the present invention, including a parabolic reflector surface and an LED depicted somewhat schematically as a point source.
Figure 3:
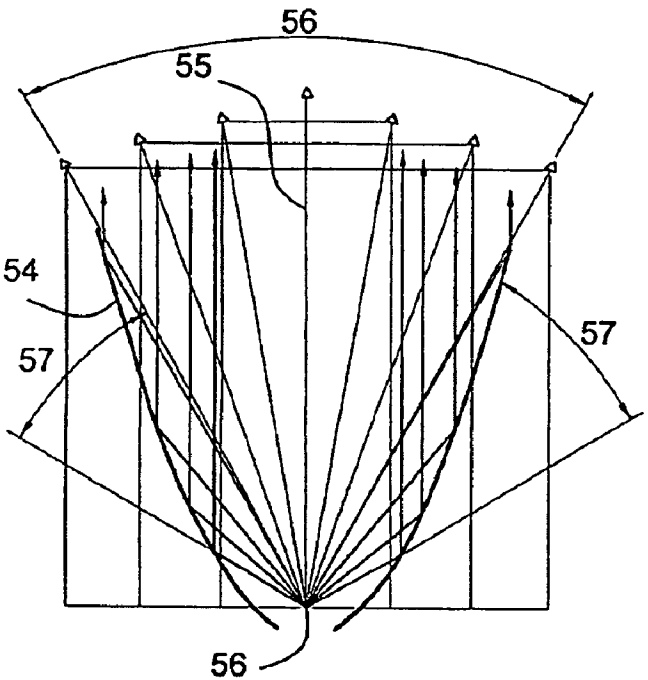
FIG. 3 PRIOR ART
FIG. 3 is a sectional view of a conventional light assembly including a conventional reflector and an LED depicted somewhat schematically as a point source.

FIG. 3 shows the amount of light from an LED that is captured by a conventional reflector system, and FIG. 4 shows the amount captured by a reflector system according to the present invention. As shown in FIGS. 3 and 4, the inventive reflector system can capture and redirect a significantly greater amount of light from an LED than from the same LED used in a conventional parabolic reflector system.

Figure 5:
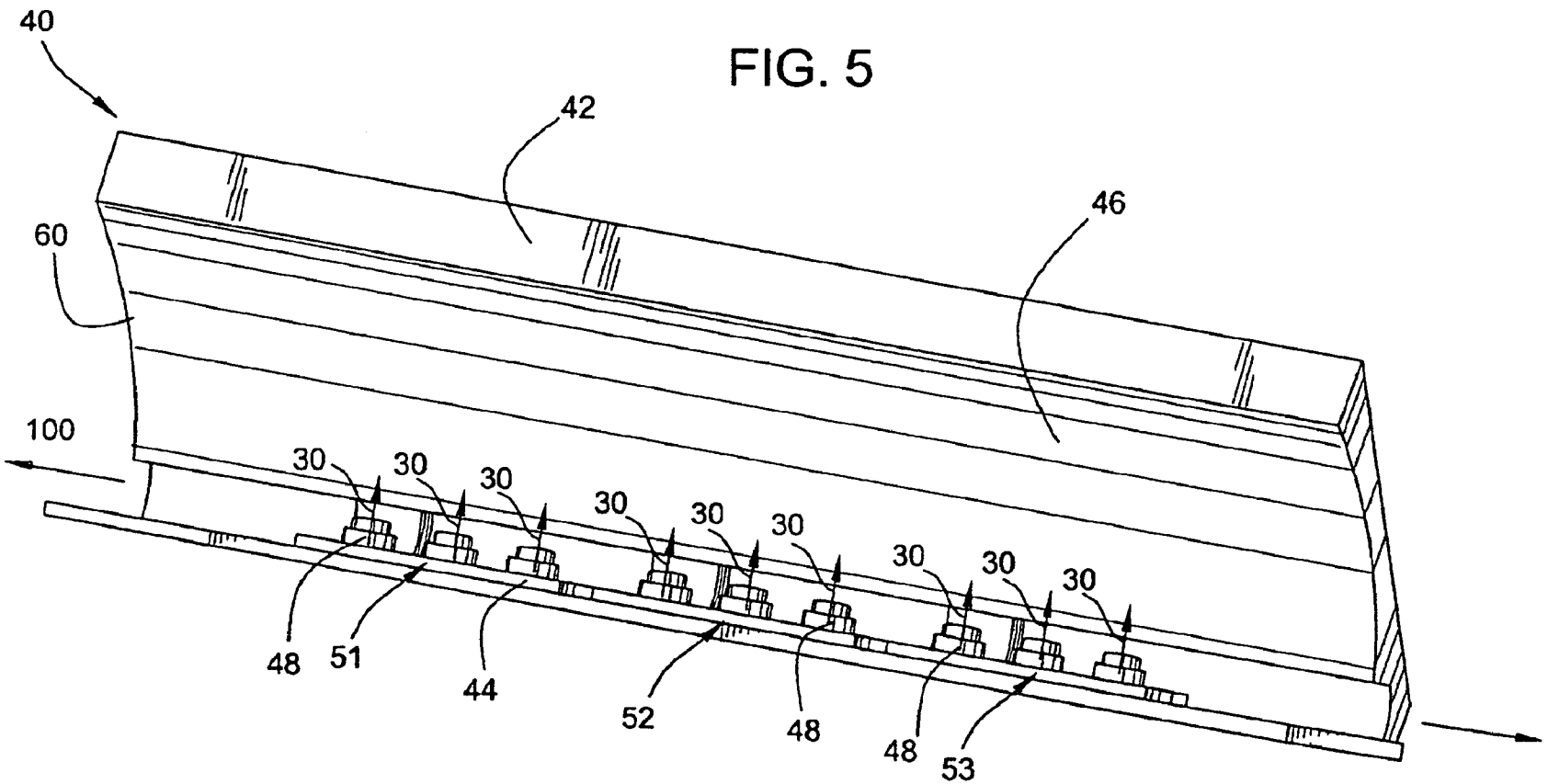
FIG. 5 is a perspective view of the light assembly of FIG. 4.

Referring to FIG. 5, an embodiment of a light assembly 40 according to the present invention is shown. The light assembly 40 can include a reflector 42 and an LED array 44. The reflector 42 includes a reflective surface 46. The LED array 44 includes a plurality of LEDs 48. In this embodiment, the LEDs 48 are arranged in three sets 51, 52, 53 of three LEDs each, for a total of nine LEDs 48. An example of a suitable LED for use in the present invention is the Lumileds Luxeon® LED as discussed in U.S. patent application Ser. No. 10/081,905, filed on Feb. 21, 2002, and entitled "LED Light Assembly," the entire contents of which are incorporated herein by reference. The light assembly 40 can also include other components, such as, a power supply and a heat sink, for example.

The LEDs 48 are placed in substantially aligned relationship with each other such that their virtual focal points are substantially aligned along an axis. As a result, the optical output axis of each LED 48 is also similarly aligned, thereby defining a virtual focal point axis 100. In this embodiment, there are nine optical output axes 30 that are disposed in substantially perpendicular relationship to the virtual focal point axis at the virtual focal of each LED 48. It will be understood that in other embodiments, the light assembly can include a single LED or a different number of LEDs.

Referring to FIG. 3, in a conventional reflector system the reflector 54 can comprise at least a portion of a paraboloid of revolution about a principal axis 55. The LED or LED array 56 is disposed such that its optical axis is substantially aligned with the principal axis 55 of the reflector 54.

Referring to FIG. 4, the reflective surface 46 includes a linear curved section 60. In this embodiment, the curved section 60 is parabolic. The equation for the parabolic curve in this example is: $y^2=1.22\,x$, where x is taken along a horizontal principal axis 70 of the parabolic section 60 and y is taken along a vertical y axis 72 which is perpendicular to the principal axis 70. The y axis 72 is parallel to a directrix 74 of the parabolic section 60. A focus 76 of the parabolic section 60 is disposed coincident with the virtual focal point axis 80 of the LED array. The output axis 82 of the LED array is substantially parallel with the y axis 72 and the directrix 74 of the parabolic section 60. The size of the parabolic curve can be based upon the angular limits of the light output of the LED array and the physical size constraints of the application in which the light assembly is intended to be used, for example.

In this example, a first end 90 of the parabola 60, which is closest to the LED 48, is at a first angle 92 from the output axis 82, while a second end 94, which is furthest from the LED 48, is at a second angle 96 from the output axis 82. The first angle 92 is measured between the output axis 82 and a line 98 extending between the focal point axis 80 and the first end 90. The second angle 96 is measured between the output axis 82 and a line 99 extending through the focal point axis 80 and the second end 94. In this embodiment, the first angle 92 is equal to 60°, and the second angle 96 is equal to 50°.

The ends 90, 94 can constitute a compromise between physical size and maximum light collection, as most of a conventional LED's light output is typically concentrated between these two angular values (see FIG. 1.). From these constraints an infinite number of parabolic curves can be created. The parabolic curve is fully constrained by placing the first endpoint 90 of the curve nearest to the LED vertically above the highest point of the LED's structure. This placement will ensure that the light reflected from this endpoint 90 will be substantially unimpeded by the LED housing. In other embodiments, the reflector can have a parabolic section with one or both of the ends disposed in different locations Referring to FIG. 5, to construct the reflective surface 46, the parabolic curve section 60 is swept along the focal axis 100 to create the reflective surface. The focal axis 100 is placed coincident with the focus of the curve section 60 and perpendicular to a plane of the curve through the principal axis 70 and the y axis 72, as shown in FIG. 4. Referring to FIG. 5, the LEDs 48 are disposed in a linear array with their virtual focal points coincident with the focal axis 100.

Figures 6A, 6B, 6C:
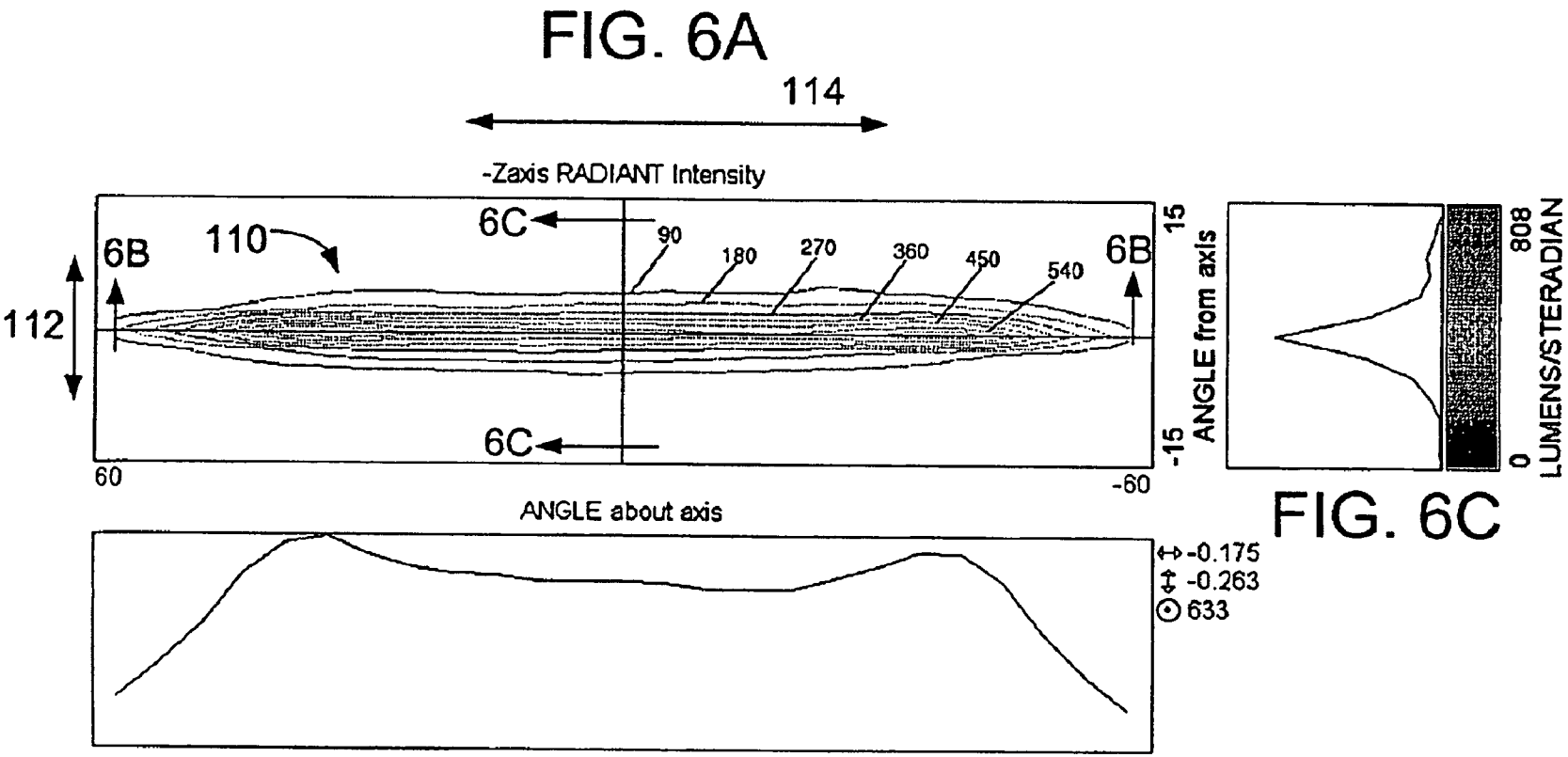
FIG. 6*a* is an isocandela plot of the light output of the light assembly of FIG. 4.
FIG. 6*b* is a cross-sectional view taken along line 6B-6B in FIG. 6*a* of the light output of the light assembly of FIG. 4.
FIG. 6*c* is a cross-sectional view taken along line 6C-6C in FIG. 6*a* of the light output of the light assembly of FIG. 4.

Referring to FIG. 4, substantially all of the light emitted from the LED array is directed toward the reflector 42 such that substantially all of the light emitted from the LED array contacts the reflective surface 46 and is reflected by the same, the light being substantially collimated by the reflective surface 46. Only a portion 104 of the light emitted by the LED array is unreflected by the reflector 42. In this embodiment, the portion 104 of unreflected light emitted by the LED array is disposed in a 10° arc segment 105 adjacent the arc segment defined by the second angle 96. The vertical vector component of all the light rays 106 leaving the LED that hit the reflector, i.e., the light emitted in the area covered by the arc segments defined by the first angle 92 and the second angle 96 (a 110° arc segment 108 in this example), is directed to the front 107 of the assembly 40 due to the parabolic shape of the reflective surface 46 while the non-vertical vector components of the rays are unchanged. This results in a light beam 110 that is very narrow in a vertical direction 112 but quite wide in a horizontal direction 114, as shown in FIG. 6. Referring to FIG. 6, the light output is shown in the form of an isocandela plot with graphs to the right and below it that show cross-sections through the light beam 110.

Figure 7:
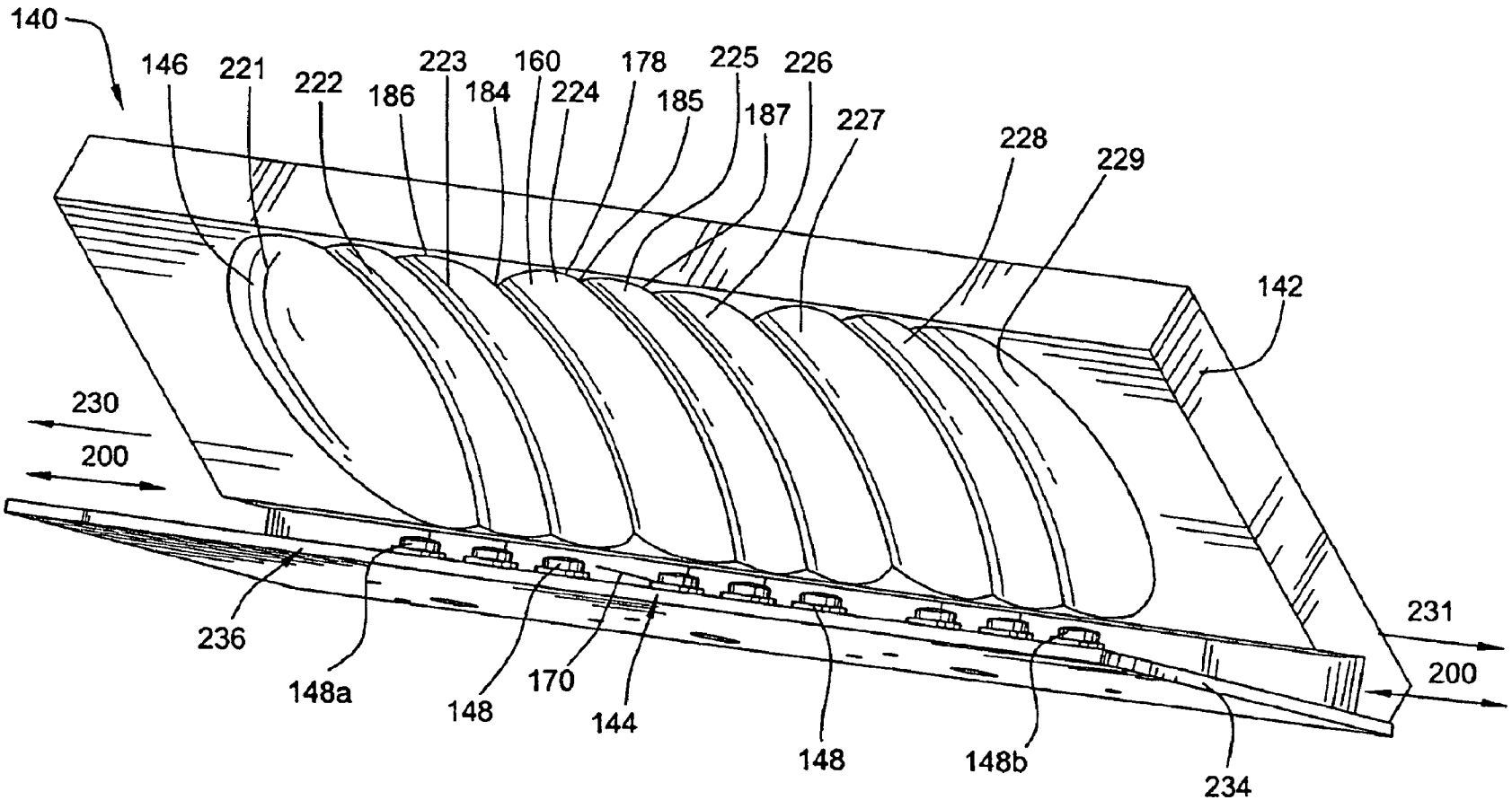
FIG. 7 is a perspective view of another embodiment of a light assembly according to the present invention.

Referring to FIG. 7, another embodiment of a light assembly 140 according to the present invention is shown. The light assembly 140 includes a reflector 142 and an LED array 144. The reflector 142 can include a reflective surface 146 having a plurality of reflective portions 221, 222, 223, 224, 225, 226, 227, 228, 229. The number of reflective portions can correspond to the number of LEDs 148 included in the light assembly 140. In this case, the LED array 144 includes nine LEDs 148. Each reflective portion can be defined by a parabolic curve section which is rotated over a predetermined arc about its principal axis to form a part of a paraboloid. The parabolic curve section can be the same as the parabolic curve section 60 of the reflector 42 of FIG. 4.

Referring to FIG. 7, the size of each reflective portion 221, 222, 223, 224, 225, 226, 227, 228, 229 can be related to the spacing of adjacent LEDs 148 with the principal axis of a particular reflective portion extending through the virtual focal point of the LED with which the particular reflective portion is associated. The extent of each reflective portion along the focal axis 200 can be delineated by its intersection with the reflective portions immediately adjacent thereto. For example, the fourth reflective portion 224 can include a parabolic section 160 that is rotated about its principal axis 170 over a predetermined arc 178. The end points 184, 185 of the arc 178 are defined by the points where the arc 178 intersects the arcs 186, 187 of the adjacent third and fifth reflective portions 223, 225, respectively. The outer extent of each end reflective portion 221, 229 preferably extends far enough to capture substantially all the light being emitted by the respective end LED 148*a*, 148*b* in a respective outer direction 230, 231 along the focal axis 200.

Figures 8A, 8B, 8C:
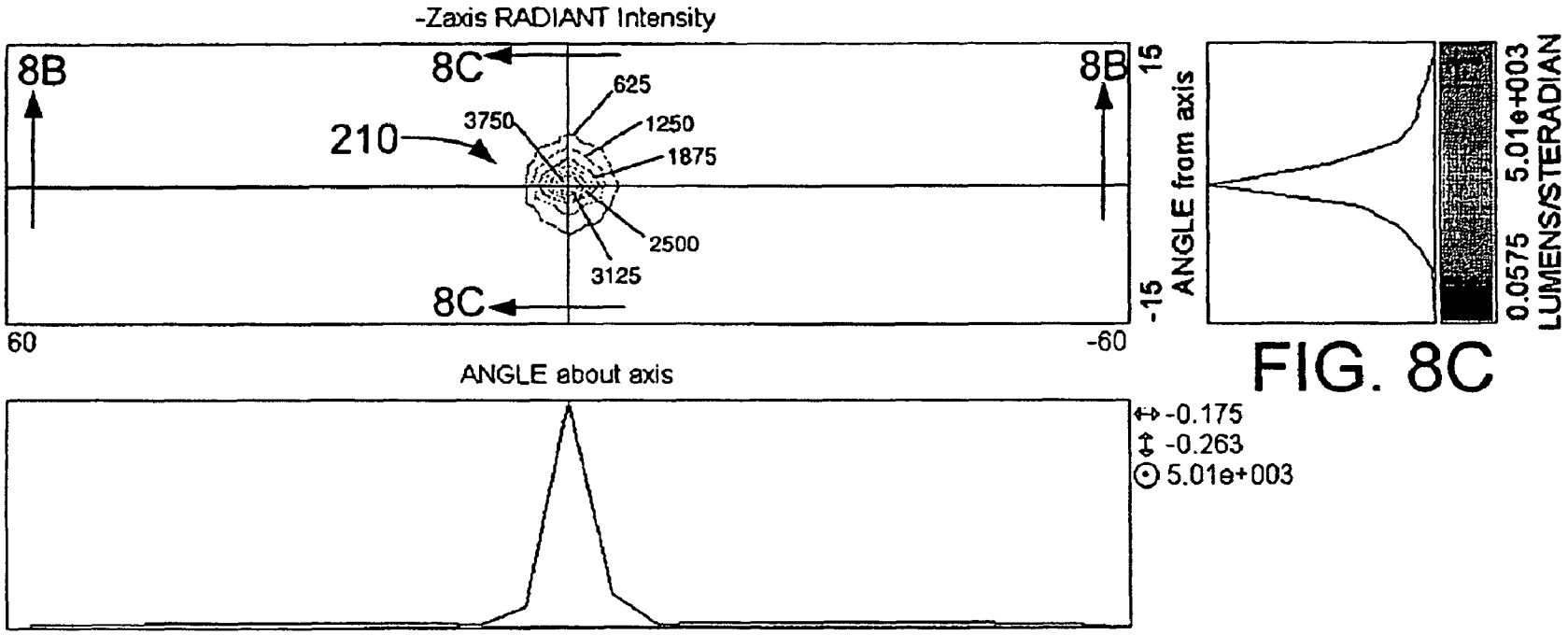
FIG. 8*a* is an isocandela plot of the light output of the light assembly of FIG. 7.
FIG. 8*b* is a cross-sectional view taken along line 8B-8B in FIG. 8*a* of the light output of the light assembly of FIG. 7.
FIG. 8*c* is a cross-sectional view taken along line 8C-8C in FIG. 8*a* of the light output of the light assembly of FIG. 7.

The reflective surface 146 can extend all the way to a plane 234 defined by the LED mounting. The light rays leaving the LED array 144 that hit the reflector 142 can be directed to the front 236 of the assembly 140 by the parabolic shape of the reflective surface 146. This reflector 142 can result in a beam of light 210, as shown in FIG. 8, that is narrower and more concentrated than the light beam 110 shown in FIG. 6. The light beam 210 can be suitable for applications that require a "spot" style beam. The light assembly 140 of FIG. 7 can be similar in other respects to the light assembly 40 of FIG. 5.

Figure 9:
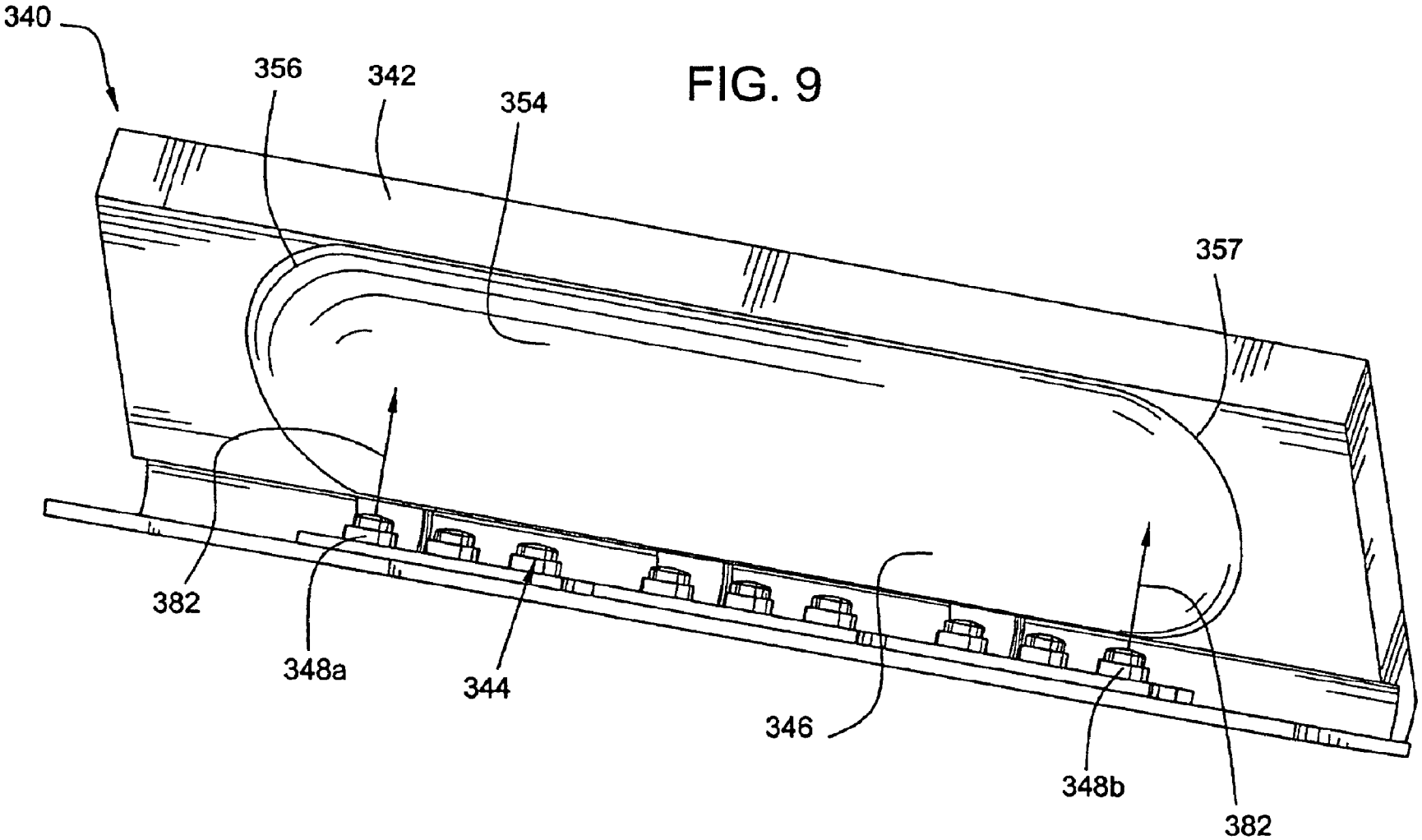
FIG. 9 is another embodiment of a light assembly according to the present invention.

Referring to FIG. 9, another embodiment of a light assembly 340 according to the present invention is shown. The light assembly 340 of FIG. 9 includes a reflector 342 and an LED array 344. The reflector 342 includes a reflective surface 346. The LED array 344 includes a plurality of LEDs 348. The reflective surface 346 has a body portion 354 flanked by two end portions 356, 357. The body portion 354 includes a parabolic section that is similar to that of the reflector 42 of the light assembly 40 of FIG. 5. Each end portion 356, 357 can be defined by rotating a parabolic curve about its principal axis over a predetermined arc. The principal axis of the parabolic curve of each end portion 356, 357 can intersect the optical output axis 382 of the end LED 348*a*, 348*b* with which the respective end portion 356, 357 is associated.

Figures 10A, 10B, 10C:
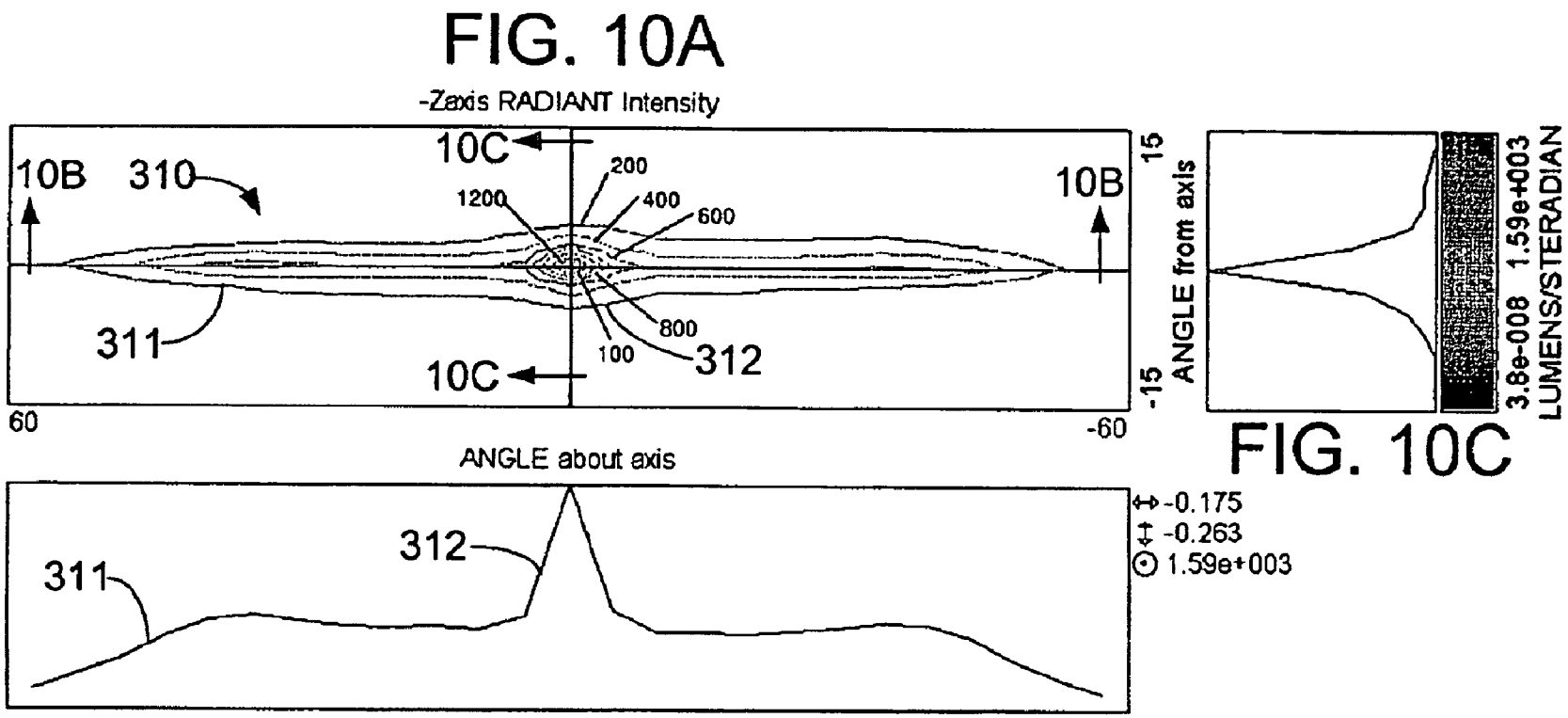
FIG. 10*a* is a isocandela plot of the light output of the light assembly of FIG. 9.
FIG. 10*b* is a cross-sectional view taken along line 10B-10B in FIG. 10*a* of the light output of the light assembly of FIG. 9.
FIG. 10*c* is a cross-sectional view taken along line 10C-10C in FIG. 10*a* of the light output of the light assembly of FIG. 9.

The reflector 342 of FIG. 9 can be useful in that it can produce a light beam 310 that can satisfy the current National Fire Protection Association (NFPA) and the General Services Administration emergency warning light specifications, which are incorporated herein by reference. The body portion 354 can produce a wide horizontal light distribution 311, as shown in FIG. 10. The end portions 356, 357 can produce a narrow, high intensity light distribution 312 visible in the center of the isocandela plot shown in FIG. 10. The current invention can use the light distribution characteristics of the LED array and the configuration of the reflective surface to provide controlled beam shaping for meeting a predetermined specification.

Figure 11:
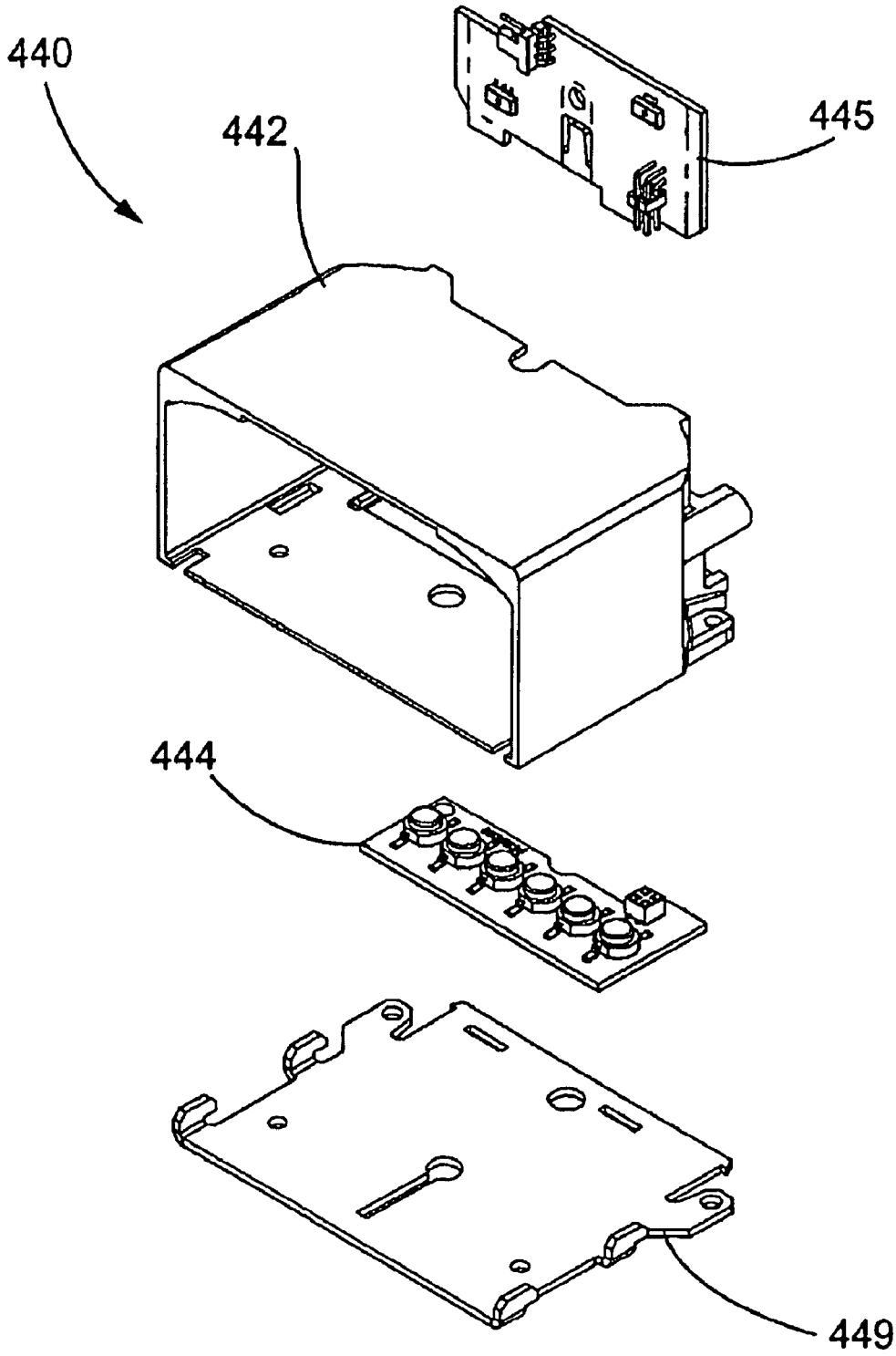
FIG. 11 is an exploded view of another embodiment of a light assembly according to the present invention.

Referring to FIGS. 11-14, another embodiment of a light assembly 440 according to the present invention is shown. FIG. 15 shows the light output characteristics of the light assembly 440 of FIG. 11. Referring to FIG. 11, the light assembly 440 can include a reflector 442, an LED array 444 disposable within the reflector 442, an LED power supply board 445 mounted to the reflector 442 and electrically connected to the LED array 444, and a heat sink 449 mounted to the reflector 442 and operably arranged with the LED array 444.

Figure 13:
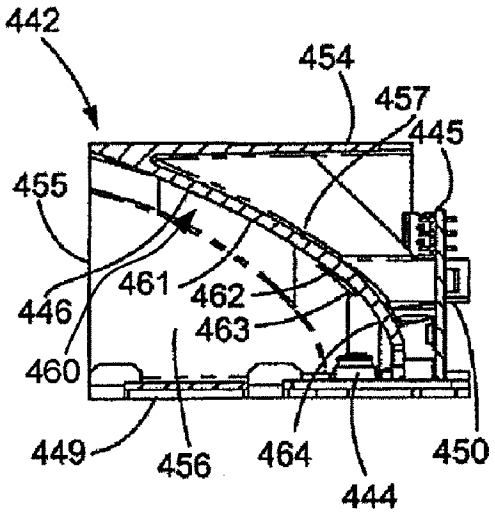
FIG. 13 is a cross-sectional view taken along line 13-13 in FIG. 12 of the light assembly of FIG. 11.
Figure 12:
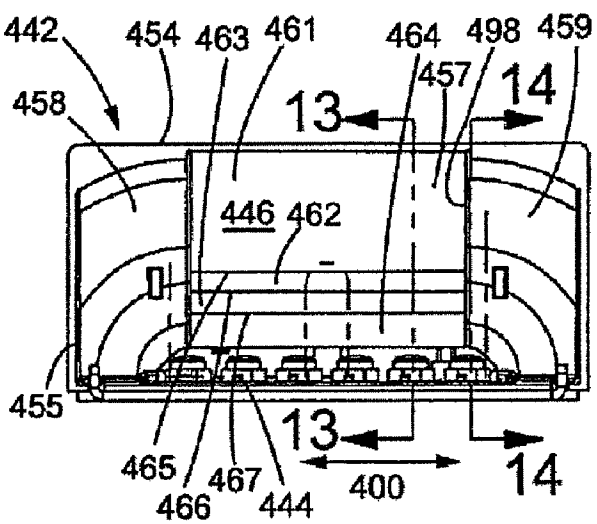
FIG. 12 is a front elevational view of the light assembly of FIG. 11.
Figure 14:
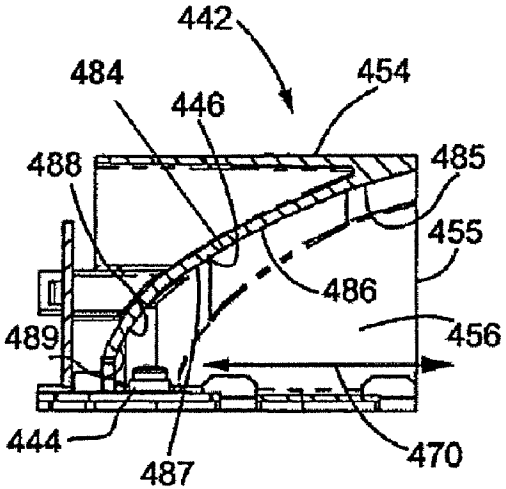
FIG. 14 is a cross-sectional view taken along line 14-14 in FIG. 12 of the light assembly of FIG. 11.
Figures 15A, 15B, 15C:
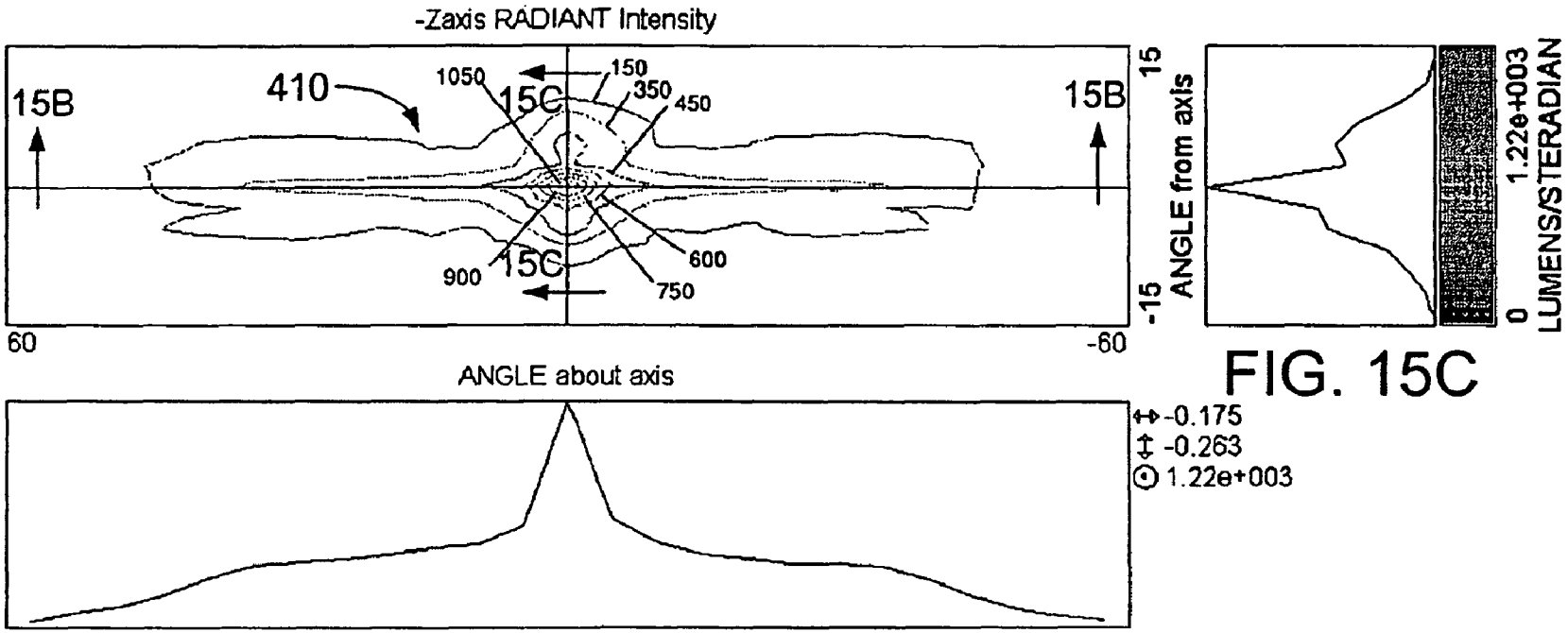
FIG. 15*a* is an isocandela plot of the light output of the light assembly of FIG. 11.
FIG. 15*b* is a cross-sectional view taken along line 15B-15B in FIG. 15*a* of the light output of the light assembly of FIG. 11.
FIG. 15*c* is a cross-sectional view taken along line C-C in FIG. 15*a* of the light output of the light assembly of FIG. 11.

Referring to FIGS. 12-14, the reflector 442 can include a housing 454 which defines an opening 455 and an interior cavity 456. The reflector 442 can include a reflective surface 446 which acts to define a portion of the cavity. The LED array 444 can be disposed within the cavity 456 of the reflector 442. The heat sink 449 can be mounted to an underside of the reflector such that the LED array 444 is in overlapping relation therewith. The LED power supply board 445 can be mounted to the reflector 442 adjacent a rear end 450 thereof. The rear end 450 can oppose the opening 455 of the reflector 442.

Referring to FIG. 12, the reflective surface 446 includes a body portion 457 and two flanking end portions 458, 459. Referring to FIG. 13, the body portion 457 can include a parabolic curve section 460 comprising a plurality of parabolic curve segments 461, 462, 463, 464. In this embodiment, the body portion 457 includes four parabolic curve segments to define the parabolic curve section. The four parabolic segments 461, 462, 463, 464 of the body portion 457 can each be defined by a different parabolic equation. The segments abut together to define the parabolic curve section 460 and establish discontinuities 465, 466, 467 therebetween. The parabolic curve section 460 can be extended along the focal axis 400 over a predetermined amount to define the body portion 457. The parabolic curve segments 461, 462, 463, 464 can have different principal axes.

In other embodiments, two or more segments of a curve section can abut together substantially without any discontinuity therebetween. In other embodiments, the two or more of the segments can have the same parabolic equation. In yet other embodiments, two or more of the segments can have the same principal axis.

The size and shape of each parabolic curve segment can be determined through an iterative process of creating a surface, performing a computer ray trace simulation of the surface, comparing the results to a predetermined specification, modifying the surface, and repeating the preceding steps until a surface which substantially matches or exceeds the specification is found. The reflective surface associated with each of these parabolic curve segments can direct light to a specific spatial area.

Referring to FIG. 14, the second end portion 459 can include a parabolic curve section 484 comprising a plurality of parabolic curve segments 485, 486, 487, 488, 489. In this embodiment, the curve section 484 of the second end portion 459 includes five parabolic curve segments. The parabolic curve segments 485, 486, 487, 488, 489 can be defined by different parabolic equations. The segments of the end portion 459 can be joined together in a manner similar to how the parabolic segments of the body portion 457 are joined. The second end portion 459 can be defined by rotating the parabolic curve segments 485, 486, 487, 488, 489 about their respective principal axes over a predetermined arc between the abutting edge 498 of the body portion 457 and the opening 470 of the reflector 442. The first end portion 458 is similar to the second end portion 459, the first end portion being a mirror image of the second end portion. In other embodiments, the first and second end portions can be different from each other.

Referring to FIG. 15, the combined effect of the body portion and the first and second end portions of the reflector of FIG. 12 is to produce a light distribution pattern 410 capable of meeting a predetermined lighting performance specification. Referring to FIG. 16, the lighting performance specification shown in the "Combined" table constitutes a composite specification. For this embodiment, a composite specification was created from two or four (depending on color) existing industry specifications to yield the light distribution pattern as shown in FIG. 15. The following industry standards were used to generate the composite specification: the "Federal Specification for the Star-of-Life Ambulance," KKK-A-1822D (November 1994), propounded by the General Services Administration; NFPA 1901 (2001 edition), standard for "Automotive Fire Apparatus," propounded by the NFPA; J595 and J845 standards, propounded by the Society of Automotive Engineers (SAE); and California Title 13, Class B standard, propounded by the State of California. The composite specification includes, for each particular location specified, the highest light value specified in the foregoing standards. The values of the various standards can be converted into a uniform unit of measurement, candelas, for example, to make the described comparison.

Figure 17:
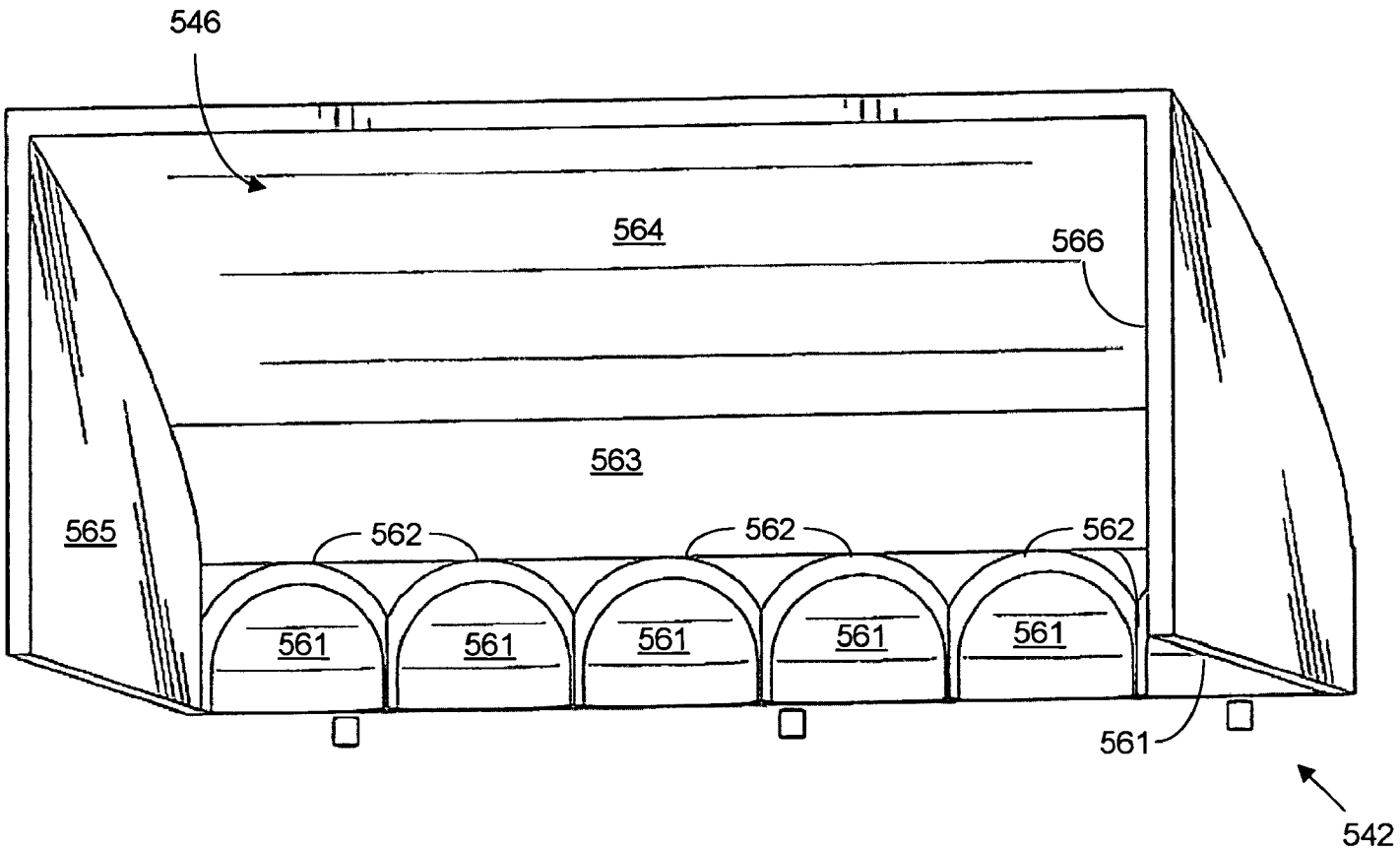
FIG. 17 is a perspective view of an embodiment of a light reflector according to the present invention.
Figure 18:
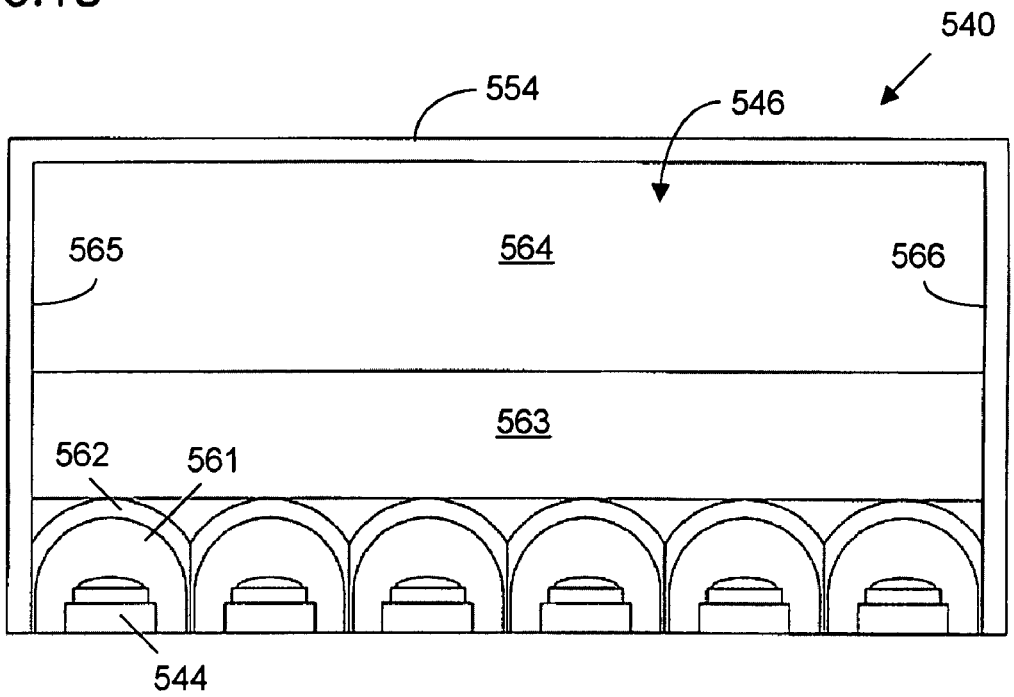
FIG. 18 is a front elevational view of a light assembly using the reflector of FIG. 17.
Figure 19:
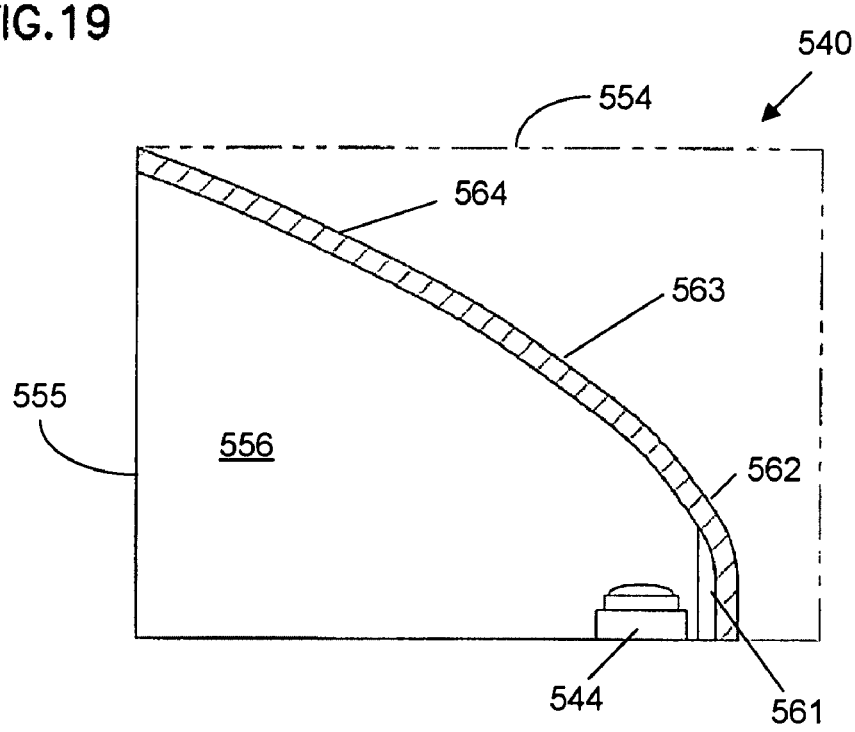
FIG. 19 is a side cross-sectional view bisecting the light assembly of FIG. 18.

Referring to FIGS. 17-19, yet another embodiment of a light assembly 540 is shown according to the present disclosure. FIG. 17 discloses various details of a reflector 542 useable in the light assembly 540, and FIGS. 18-19 disclose the assembly 540 generally. The reflector 542 includes a housing 554 defining an opening 555 and an interior cavity 556. The reflector 542 includes a reflective surface 546 which defines a portion of the cavity 556. The reflector 542 includes a plurality of shaped sections configured to direct the incident light from the LED array 544 associated with the reflector, shown in FIGS. 18-19, in various directions to provide visibility of the assembly 540 at a wide viewing angle. The LED array 544 corresponds generally to the LED arrays previously disclosed in FIGS. 12-14. In the embodiment shown, the LED array 544 includes six equally-spaced LED's shown, such as in FIG. 9.

The reflective surface 546 is generally parabolic in cross-sectional shape, and includes a plurality of reflective regions 561, 562, 563, and 564. One of the reflective regions corresponds to a plurality of parabolic regions 561 residing along a rear end 550 of the reflector are configured to direct a portion of the light emitted from the LED array 544 to the center, or H-V point of the beam pattern. Each of the regions 561 is defined by the same parabolic function, and each region 561 directs light emitted from a corresponding one of the LEDs in the array. In the embodiment shown, six parabolic regions 561 exist in the reflector, corresponding with the six LED's in the LED array 544. A second region 562 immediately bordering the parabolic regions 561 acts to direct light 10 degrees up and down. A third region 563 above the parabolic regions directs light five degrees up and down. A fourth region 564 extending toward the opening of the reflector 542 directs light at various angles extending horizontally outward from the reflector. The segments abut together to define the parabolic curve of the reflector 542 and optionally establish discontinuities therebetween.

In some embodiments of the reflector 542, two or more segments of a curve section can abut together substantially without any discontinuity therebetween. In other embodiments, the two or more of the segments can have the same parabolic equation. In yet other embodiments, two or more of the segments can have the same principal axis.

The reflector 542 further includes a pair of flanking planar reflective surfaces 565, 566. When the reflector 542 is viewed at an angle, the flanking planar reflective surfaces 565, 566 reflect the output of the LEDs to simulate an extended length of the reflector when viewed at an angle. In one embodiment, the flanking planar reflectors 565, 566 are placed at a distance one half the distance between two of the LED's, causing an appearance of a continuous array of LED's based on the reflected LED light in the appropriate planar reflector 565, 566.

Optionally the assembly 540 includes an LED power supply board a heat sink, as described above in conjunction with FIGS. 11-14. Other power and heat sink configurations are possible as well.

Figure 20A:
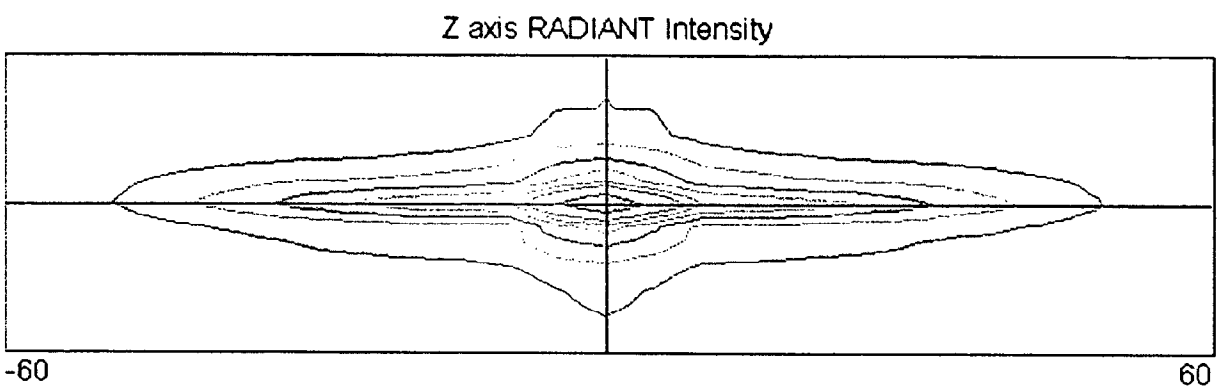
FIG. 20A is an isocandela plot of the light output of the light assembly of FIG. 18.
Figure 20B:
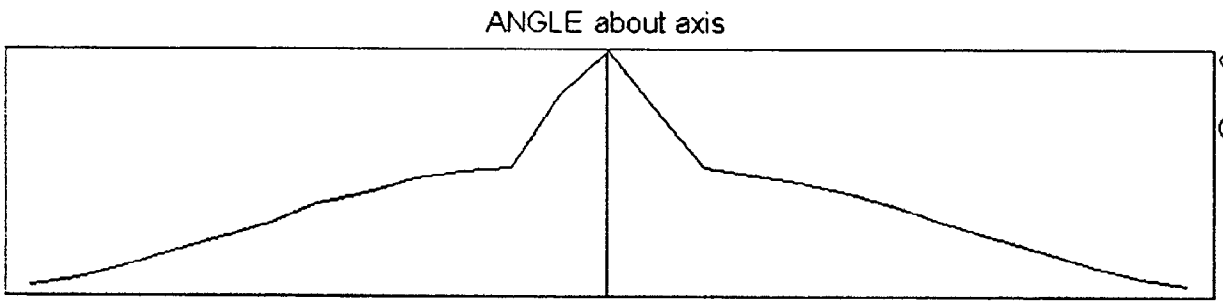
FIG. 20B is a cross-sectional view taken along line 20B in FIG. 20A of the light output of the light assembly of FIG. 17.
Figure 20C:
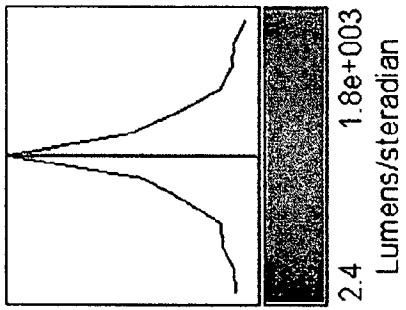
FIG. 20C is a cross sectional view taken along line 20C in FIG. 20A of the light output of the light assembly of FIG. 17.

FIGS. 20A-C shows the light output characteristics of the light assembly 540 of FIGS. 17-19. The light output is shown in the form of an isocandela plot (FIG. 20A) with graphs to the right (FIG. 20C) and below it (FIG. 20B) that show cross-sections through the light beam 510.

Thus, the exemplary embodiments of the present disclosure show how the reflective surface of the reflector can be configured to provide very different light output characteristics. This ability is highly desirable since optical performance specifications vary widely within the various lighting markets. While only some variations based on parabolic cross sections of the reflector are illustrated, an infinite number of variations can be developed to meet a required beam distribution. It should be noted that the base curve of the reflector is also not limited to parabolic cross sections. Other curves such as hyperbolic, elliptic, or complex curves can be used.

All references, including publications, patent applications, and patents, cited herein are hereby incorporated by reference in their entirety.

The use of the terms "a" and "an" and "the" and similar referents in the context of describing the invention is to be construed to cover both the singular and the plural, unless otherwise indicated herein or clearly contradicted by context. All methods described herein can be performed in any suitable order unless otherwise indicated herein or otherwise clearly contradicted by context. The use of any and all examples, or exemplary language (e.g., "such as") provided herein is intended to illuminate the invention and does not pose a limitation on the scope of the invention unless otherwise claimed. No language in the specification should be construed as indicating any non-claimed element as essential to the practice of the invention.

Preferred embodiments of this invention are described herein. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A light assembly comprising:

an array of light emitting diodes for a warning light generating a beam pattern having a center axis, wherein the light emitting diodes are arranged along a line, and wherein adjacent light emitting diodes are each regularly spaced at a first distance relative to one another along the line;

a plurality of contiguous reflective regions with each region having optical properties distinct from optical properties of adjacent regions, where the plurality of contiguous reflective regions form a composite reflective surface having a generally parabolic cross-sectional shape, the composite reflective surface positioned to reflect at least a portion of the light emitted by each of the light emitting diodes from each of the reflective regions such that a center axis of the reflected light reflects in a direction generally perpendicular to the center axis of each of the light emitting diodes;

one of the plurality of contiguous reflective regions including a plurality of parabolic regions configured to direct a portion of the reflected light emitted from the array of light emitting diodes to the center axis, with one of the parabolic regions corresponding to each of the light emitting diodes, and further comprising a second region bordering each of the parabolic regions configured to direct light up and down; and a pair of flanking reflective surfaces positioned on opposed ends of the array of light emitting diodes, each of the flanking reflective surfaces being flat, the flanking reflective surfaces each including a leading edge positioned adjacent to an outermost point of the contiguous reflective regions, and a trailing edge following the contiguous reflective regions to the leading edge, and the line along which the array of light emitting diodes is arranged intersects and is normal to each of the flanking reflective surfaces, wherein each of the flanking reflecting surfaces is positioned at a second distance, the second distance being one half the first distance between adjacent light emitting diodes so that the flanking reflective surfaces simulate an extended length of the reflector.

2. The light assembly of claim 1, wherein the reflective surface includes a curved section.

3. The light assembly of claim 1, wherein the reflective surface further includes a reflective region configured to direct light at various angles extending outward from the reflector.

4. The light assembly of claim 1, wherein the reflective surface further includes a reflective region configured to direct light five degrees up and down.

5. The light assembly of claim 1, further comprising a power supply operably arranged with the array of light emitting diodes such that the array is selectively operable to emit light.

6. The light assembly of claim 1, further comprising a heat sink operably arranged with the array of light emitting diodes.

7. A light assembly for directing light comprising:

light emitting diodes (LEDs) for a warning light extending along a line, each having an optical output axis;

a reflector comprising a composite of parabolic curve sections, each having a principal axis that is substantially perpendicular to the optical output axis of each of the one or more LEDs so as to redirect light from each of the LEDs along a direction substantially in common with a common direction of the principal axes; and one of the parabolic curve sections including a plurality of parabolic regions configured to direct a portion of the reflected light emitted from each of the LEDs to the optical output axis, with one of the parabolic regions corresponding to each of the LEDs, and further comprising a second region bordering each of the parabolic regions configured to direct light up and down;

a pair of flanking reflective surfaces cooperating with the composite of parabolic curve sections to provide a substantially unidirectional spatial pattern of light emanating from the one or more LEDs, the flanking reflective surfaces being perpendicular to the reflective surface and parallel to one or more planes including both an output optical axis of a light emitting diode from the one or more LEDs and a center axis of light reflected by the reflector originating from the light emitting diode, and the line along which the LEDs extends is normal to the flanking reflective surfaces.

8. The light assembly of claim 7, wherein the pair of flanking reflective surfaces is each planar.

9. The light assembly of claim 7, wherein the pair of flanking reflective surfaces is each substantially parabolic.

10. The light assembly of claim 7, wherein the pair of flanking reflective surfaces is positioned on opposed ends of the one or more light emitting diodes at a distance one half a predetermined distance between two LEDs.

* * * * *